US008199956B2

(12) United States Patent
Haartsen et al.

(10) Patent No.: US 8,199,956 B2
(45) Date of Patent: Jun. 12, 2012

(54) ACOUSTIC IN-EAR DETECTION FOR EARPIECE

(75) Inventors: Jacobus Cornelis Haartsen, Hardenberg (NL); Gerrit Sampimon, Erm (NL); Bart Trip, Emmen (NL)

(73) Assignee: Sony Ericsson Mobile Communications, AB Lund (SE)

( * ) Notice: Subject to any disclaimer, the term of this patent is extended or adjusted under 35 U.S.C. 154(b) by 682 days.

(21) Appl. No.: 12/358,289

(22) Filed: Jan. 23, 2009

(65) Prior Publication Data

US 2010/0189269 A1 Jul. 29, 2010

(51) Int. Cl.
*H04R 29/00* (2006.01)

(52) U.S. Cl. ..... 381/375; 381/56; 381/74

(58) Field of Classification Search ..... 381/375
See application file for complete search history.

(56) References Cited

U.S. PATENT DOCUMENTS

| | | | | |
|---|---|---|---|---|
| 2006/0045304 | A1 | 3/2006 | Lee et al. | |
| 2008/0123882 | A1 | 5/2008 | Bauml et al. | |
| 2008/0146890 | A1 | 6/2008 | Leboeuf et al. | |
| 2008/0298606 | A1 | 12/2008 | Johnson et al. | |
| 2010/0189268 | A1 * | 7/2010 | Haartsen et al. | 381/56 |

FOREIGN PATENT DOCUMENTS

| | | | |
|---|---|---|---|
| WO | 03/088841 | | 10/2003 |
| WO | WO 2007110807 | A2 * | 10/2007 |

OTHER PUBLICATIONS

International Search Report for corresponding international application No. PCT/EP2009/059191 dated Oct. 12, 2009.
Written Opinion for corresponding international application No. PCT/EP2009/059191 dated Oct. 12, 2009.
Jacobus Cornelius Haartsen et al; Apparatus, Method, and Computer Program for Detecting a Physiological Measurement From a Physiological Sound Signal, U.S. Appl. No. 12/272,072, filed Nov. 17, 2008, Considered submitted application documents.

* cited by examiner

*Primary Examiner* — Kenneth Parker
*Assistant Examiner* — Yu Chen
(74) *Attorney, Agent, or Firm* — Renner, Otto, Boisselle & Sklar, LLP

(57) ABSTRACT

An apparatus comprising at least one earpiece suitable to be applied at an auditory opening of a user's ear and a signal processor is disclosed. The earpiece comprises a speaker enabled to be supplied with an audio signal for rendering, and a microphone arranged in vicinity of the speaker arranged to acquire a sound signal. The signal processor is arranged to determine whether the earpiece is applied at the user's ear by analysis of the acquired sound signal, wherein the analysis is based on the acoustic coupling of the audio signal to the microphone. A method and a computer program are also disclosed.

36 Claims, 2 Drawing Sheets

ACOUSTIC IN-EAR DETECTION FOR EARPIECE

TECHNICAL FIELD

The present invention relates to an apparatus, a method, and a computer program for detecting application of an earpiece. In particular, the invention relates to detection of the application made from acoustic coupling between provided audio signal and a microphone of the earpiece.

BACKGROUND

Devices utilizing earphones, wired or wireless, for providing speech, music, etc. to a user have become popular. Such devices can be portable media players, mobile telephones, and portable digital assistants. Detection of whether the earphone is in listening position, i.e. applied at the ear, has been utilized for reducing power consumption when the user is not able to listen to any provided audio content. For example in US 2006/0045304 A1, it is disclosed that a detection element comprising two electrodes on an outer surface of the earphone body such that when the earphone is applied at the ear, skin within the ear comes into contact with the electrodes. The head of the user conducts electricity between the electrodes whereby application of the earphone at the ear can be detected.

However, since the devices are intended to be used by any ordinary user, it is considered uncertain that detection of application is ensured since any of the electrodes may have poor contact with tissue of user. It is therefore a further desire to provide gear that provides a more reliable detection while it is still easy to use by an ordinary user.

SUMMARY

The present invention is based on the understanding that an ordinary user is comfortable with using earphones, and that addition of a microphone in an earphone can be used for acquiring sounds from which measurements on sounds present at the earphone. From the acquired sounds, detection can be made based on acoustic coupling from provided audio to the earphone to determine whether the earphone is applied at the user's ear.

According to a first aspect, there is provided an apparatus comprising at least one earpiece suitable to be applied at an auditory opening of a user's ear and a signal processor. The earpiece comprises a speaker enabled to be supplied with an audio signal for rendering, and a microphone arranged in vicinity of the speaker arranged to acquire a sound signal. The signal processor is arranged to determine whether the earpiece is applied at the user's ear by analysis of the acquired sound signal, wherein the analysis is based on the acoustic coupling of the audio signal to the microphone.

The microphone may be arranged to acquire a sound signal from sounds present inside an auditory opening of the user's ear when the earpiece is applied at the ear.

The apparatus may comprise two earpieces, wherein the acoustic coupling is between the speaker of one earpiece and the microphone of another earpiece. The analysis may then be based on a propagation delay between the speaker of one earpiece and the microphone of another earpiece wherein the earpieces are determined to be applied if the propagation delay corresponds to a delay for propagating through a head. Alternatively, or additionally, the audio signal provided to the one earpiece may comprise a sub-signal such that the sound signal acquirable at the another earpiece comprises a signal component emanating from sound provided at the user's other ear and which sound is modulatedly attenuated by pulsating blood of veins of the user when the sound propagates through the head of the user when the earpieces are applied, such that a heartbeat is extractable from the signal component to determine that the earpieces are applied. The signal processor may be arranged to extract the heartbeat by low pass filtering the sound signal in a low pass filter. The low pass filter may have a cutoff frequency between 3 and 10 Hz, preferably between 3 and 5 Hz, preferably about 4 Hz.

The audio signal provided to the one earpiece may comprise a sub-signal comprising any of a tone in sub-sonic or ultra-sonic frequency, and a wideband pulse, and the signal processor may be arranged to discriminate the acquired sound signal at the another earpiece to determine the acoustic coupling.

The acoustic coupling may be between the speaker and the microphone of one or each earpiece.

The microphone may be arranged to acquire a sound signal from sounds present outside the earpiece. The acoustic coupling may be between the speaker and the microphone of one or each earpiece.

The apparatus may further comprise an application arranged to control features of the application based on the determination whether the earpiece is applied or not. The application may be arranged to interrupt rendering associated with the audio signal when the earpiece is determined to not be applied, and arranged to resume the rendering when the earpiece is determined to be applied. The application may be arranged to establish communication associated with the audio signal when the earpiece is determined to be applied, and arranged to terminate the communication when the earpiece is determined to not be applied.

According to a second aspect, there is provided a method for an apparatus comprising at least one earpiece suitable to be applied at a user's ear for rendering an audio signal in the user's ear when the earpiece is applied at the ear. The method comprises acquiring a sound signal by a microphone of the earpiece arranged in vicinity of the speaker; and determining whether the earpiece is applied at the user's ear by analyzing the sound signal based on acoustic coupling of the audio signal to the microphone.

The acquiring may comprise acquiring a sound signal at a position of the earpiece such that sounds present inside an auditory opening of the user's ear are acquired when the earpiece is applied at the ear.

The method may comprise providing the audio signal to a speaker of one earpiece, wherein the acquiring is at the microphone of another earpiece. The analyzing may then comprise determining a propagation delay between the speaker of the one earpiece and the microphone of the another earpiece wherein the earpieces are determined to be applied if the propagation delay corresponds to a delay for propagating through a head. Alternatively, or additionally, the audio signal provided to the one earpiece may comprise a sub-signal such that the sound signal acquirable at the another earpiece comprises a signal component emanating from sound provided at the user's other ear and which sound is modulatedly attenuated by pulsating blood of veins of the user when the sound propagates through the head of the user when the earpieces are applied, such that a heartbeat is extractable from the signal component to determine that the earpieces are applied. The method may further comprise extracting the heartbeat by low pass filtering the sound signal in a low pass filter. The low pass filter may have a cutoff frequency between 3 and 10 Hz, preferably between 3 and 5 Hz, preferably 4 Hz.

The providing of the audio signal to the one earpiece may comprise providing a sub-signal comprising any of a tone in sub-sonic or ultra-sonic frequency, and a wideband pulse, and the analyzing comprises discriminating the acquired sound signal at the another earpiece to determine the acoustic coupling.

The acoustic coupling may be between the speaker and the microphone of one or each earpiece.

The acquiring may comprise acquiring a sound signal at a position of the earpiece such that sounds present outside the earpiece are acquired although the earpiece is applied at the ear. The acoustic coupling may be between the speaker and the microphone of one or each earpiece.

The method may further comprise controlling features of an application based on the determination. The method may further comprise interrupting rendering associated with the audio signal when the earpiece is determined to not be applied; and resuming the rendering when the earpiece is determined to be applied. Additionally or alternatively, the method may further comprise establishing communication associated with the audio signal when the earpiece is determined to be applied; and terminating the communication when the earpiece is determined to not be applied.

According to a third aspect, there is provided a computer readable medium comprising program code comprising instructions which when executed by a processor is arranged to cause the processor to perform the method according to the second aspect.

It may include instructions causing supplying an audio signal to a speaker of at least one earpiece suitable to be applied at a user's ear for rendering the audio signal in the user's ear when the earpiece is applied at the ear; acquiring a sound signal by a microphone of the earpiece arranged in vicinity of the speaker; and determining whether the earpiece is applied at the user's ear by analysis of the acquired sound signal based on acoustic coupling of the audio signal to the microphone.

The supplying of the audio signal may be caused to be made to one earpiece and the acquiring is made at another earpiece. The analyzing may then comprise determining a propagation delay between the speaker of the one earpiece and the microphone of the another earpiece wherein the earpieces are determined to be applied if the propagation delay corresponds to a delay for propagating through a head. Alternatively, or additionally, the instructions may include causing the audio signal provided to one earpiece to comprise a sub-signal such that the sound signal acquirable at another earpiece comprises a signal component emanating from sound provided at the user's other ear and which sound is modulatedly attenuated by pulsating blood of veins of the user when the sound propagates through the head of the user when the earpieces are applied, such that a heartbeat is extractable from the signal component to determine that the earpieces are applied. The computer program may further include instructions for extracting the heartbeat by low pass filtering the sound signal in a low pass filter. The instructions may be adapted to cause the low pass filter to have a cutoff frequency between 3 and 10 Hz, preferably between 3 and 5 Hz, preferably 4 Hz.

The instructions may be adapted to cause providing of the audio signal to the one earpiece to comprise providing a sub-signal comprising any of a tone in sub-sonic or ultra-sonic frequency, and a wideband pulse, and the analyzing to comprise discriminating the acquired sound signal at the another earpiece to determine the acoustic coupling.

The instructions may be adapted to cause the acquiring to comprise acquiring a sound signal at a position of the earpiece such that sounds present outside the earpiece are acquired although the earpiece is applied at the ear.

The computer program may further comprise instructions for controlling features of an application based on the determination. The instructions may further be adapted to cause interrupting of rendering associated with the audio signal when the earpiece is determined to not be applied; and resuming the rendering when the earpiece is determined to be applied.

The instructions may further be adapted to cause establishing of communication associated with the audio signal when the earpiece is determined to be applied; and terminating of the communication when the earpiece is determined to not be applied.

DETAILED DESCRIPTION

Figure 1:
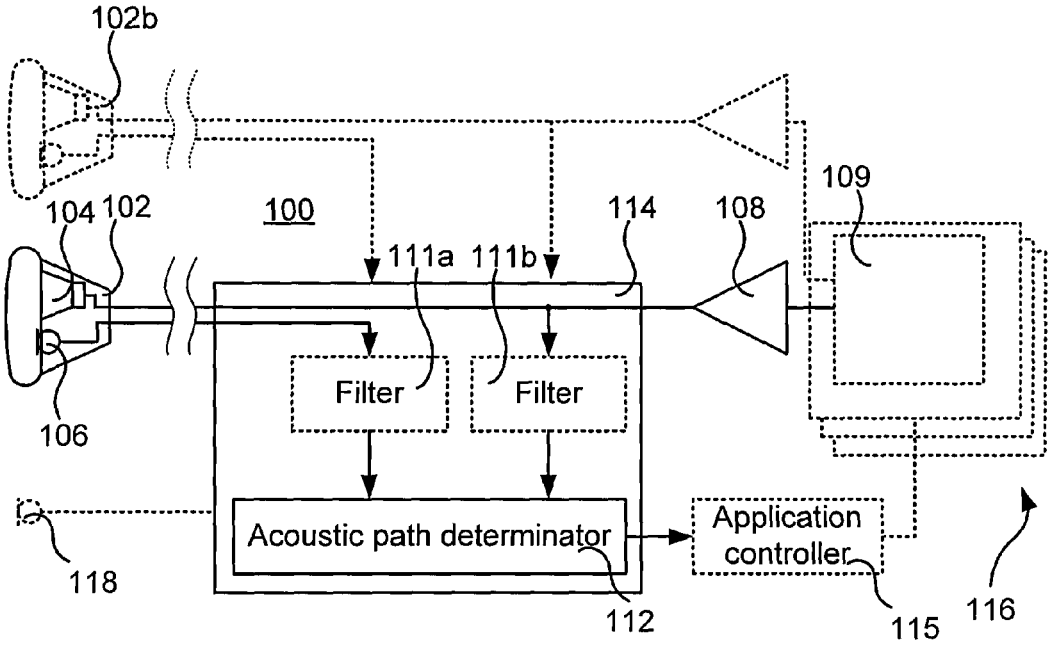
FIG. 1 schematically illustrates an apparatus according to an embodiment.

FIG. 1 schematically illustrates an apparatus 100 according to an embodiment. The apparatus 100 comprises a speaker arrangement 102, i.e. an earpiece arranged to be applied at an auditory opening of a user's ear, having a speaker 104 and a microphone 106 arranged together with the speaker 104. The speaker 104 is provided with an audio signal, e.g. music or speech, which preferably is provided by an amplifier 108, which in turn may get the audio content from an application element 109, e.g. a media player or audio output of a telephone. The microphone 106, which is arranged to acquire sounds present in the auditory opening of the ear when the earpiece is applied at the ear, and which will acquire other sounds as ambient noise when not applied, can provide its output signal to an optional filter 111*a*, which can filter the acquired signal from the microphone signal before provision on the acquired signal to an acoustic path determinator 112. Further optionally, the audio sound provided by amplifier 108 may be filtered by a filter 111*b* before input to the acoustic path determinator 112.

The acoustic path determinator 112, which preferably is implemented by a signal processor 114, is arranged to determine whether the earpiece is applied at the user's ear by analyzing the acquired sound signal in view of the provided audio signal.

The optional filter(s) 111*a, b*, and the acoustic path determinator 112 can be part of the signal processor 114 performing the functions of the elements 111*a, b*, 112, for example in analog or digital domain.

The acoustic path determination can be performed based on the acoustic properties of one earpiece 102, or each earpiece 102, 102*b* when the apparatus 100 comprises two earpieces. That is, the speaker of the earpiece provides an output of sound and the microphone of the same earpiece acquires the sound signal. When the earpiece is applied in a user's ear, the acoustic coupling between the speaker and the microphone will have a certain property since the sound will be present in a somehow closed cavity, i.e. the auditory opening of the ear, and when not applied, the coupling will have another property due to the open space around the sound emitting end of the earpiece will be much larger than the volume of the auditory opening of the ear. This can be determined from the acquired sound signal. Thus, it can be determined whether the earpiece is applied in the ear or not.

The acoustic path determination can be performed based on the acoustic properties of two earpieces 102, 102*b*, wherein the acoustic coupling is between the speaker of one earpiece 102 and the microphone of another earpiece 102*b*. Here, the fact that the speed of sound is higher when propagating through tissue than when propagating through air can be utilized for determining whether the earpieces are applied. Since the size of a head and the propagation speed in tissue are approximately known, as well as the timings of the provided signal to the speaker and the acquired signal from the microphone, determination whether the earpieces are applied or not can be determined from the propagation delay from one earpiece to the another. If the propagation delay is within a range corresponding to the expected delay through the user's head, the earpieces are considered applied, and if out of that range, they are considered not to be applied. To discriminate propagation through the tissue from the case where the earpieces happens to be separated with a corresponding delay to the range, but in open air, e.g. in a bag or pocket, other properties can be considered, such as frequency characteristics, attenuation, etc.

In one embodiment, the audio signal provided to the one earpiece 102 can comprise a sub-signal such that the sound signal acquirable at the another earpiece 102*b* comprises a signal component emanating from sound provided at the user's other ear. The sound is modulatedly attenuated by pulsating blood of veins of the user when the sound propagates through the head of the user when the earpieces are applied, such that a heartbeat is extractable from the signal component to determine that the earpieces are applied. By determination of a heartbeat, it is certainly sure that the earpieces are applied in the ears of a user, and not mistakenly determined by an acoustic coupling caused by for example the user keeping the earpieces in a pocket where acoustic coupling may resemble the one of an auditory opening of an ear. By nature, the heartbeat produces a weak sound in the head of the user with frequency components mainly corresponding to the heart rate. The sound signal acquired by the microphone 106 can be amplified, filtered and processed to enable detection of the heart beat sounds. A narrow filter can enhance the heart sound signal significantly. Preferably, the signal processor 114 is arranged to extract the heartbeat by low pass filtering the sound signal in a low pass filter. This due to the main frequency of the heartbeat comes from the heartbeat itself, which is normally between 40 and 200 heartbeats per minute. A suitable cutoff frequency for the low pass filter is thus preferably between 3 and 10 Hz, preferably between 3 and 5 Hz, preferably about 4 Hz. This has the further advantage that in these low frequencies, speech and music component of the audio signal is normally very weak.

The audio signal provided to the one earpiece can comprise a sub-signal for the determination comprising for example a tone in sub-sonic or ultra-sonic frequency, or a wideband pulse, wherein the signal processor is arranged to discriminate the acquired sound signal at the another earpiece to determine the acoustic coupling. This has the further advantage that in these frequencies, speech and music component of the audio signal is normally very weak.

The determination from presence of physiological sounds is considered as a reliable approach. Acquiring and processing of physiological sounds are described in U.S. utility patent application Ser. No. 12/272,072 filed 17 Nov. 2008, which is hereby incorporated by reference.

Figure 2:
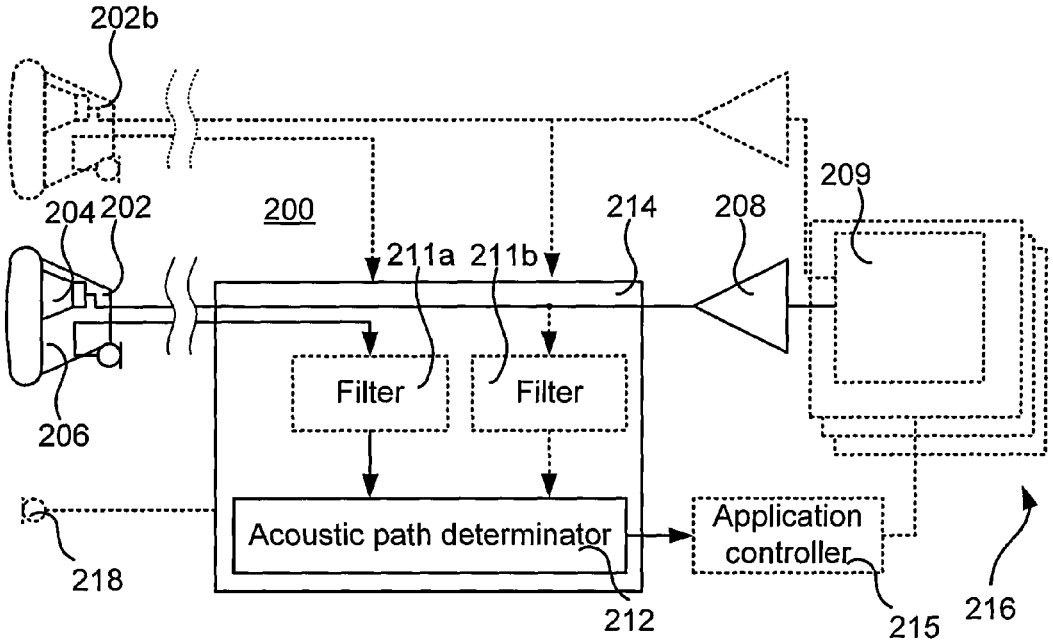
FIG. 2 schematically illustrates an apparatus according to an embodiment.

FIG. 2 schematically illustrates an apparatus 200 according to an embodiment. The apparatus 200 comprises a speaker arrangement 202, i.e. an earpiece arranged to be applied at an auditory opening of a user's ear, having a speaker 204 and a microphone 206 arranged at the earpiece 202. The speaker 204 is provided with an audio signal, e.g. music or speech, which preferably is provided by an amplifier 208, which in turn may get the audio content from an application element 209, e.g. a media player or audio output of a telephone. The microphone 206 is arranged to acquire sounds present outside the earpiece although the earpiece is applied in the ear of a user. The microphone 206 will acquire other sounds such as ambient noise, which can be used for noise cancelling applications, as for example in noise cancelling headphones. The microphone 206 can provide its output signal to an optional filter 211*a* before provision to an acoustic path determinator 212. Further optionally, the audio sound provided by amplifier 208 can be filtered by a filter 211*b* before input to the acoustic path determinator 212.

The acoustic path determinator 212, which preferably is implemented by a signal processor 214, is arranged to determine whether the earpiece is applied at the user's ear by analyzing the acquired sound signal in view of the provided audio signal.

The optional filter(s) 211*a, b*, and the acoustic path determinator 212 can be part of the signal processor 214 performing the functions of the elements 211*a, b*, 212, for example in analog or digital domain.

For any of the embodiments demonstrated with reference to FIGS. 1 and 2, the acoustic properties can also be determined based on their frequency properties, since high frequencies are normally attenuated more by tissue of the user than low frequencies. Also, low frequencies couples more in the closed environment of the auditory opening of the ear than in open space when considering the acoustic coupling between the speaker and the microphone of the same earpiece. Thus, by observing acquired sound signal, and determining distribution over frequency compared to the sound signal provided to the speaker, the acoustic coupling and thus whether the earpiece or earpieces are applied or not can be determined.

One or more of these determination techniques can be used for the determination. For example, the determination can be made from acoustic coupling of only one earpiece, or of two earpieces, and in combination with any of frequency characteristics or delay characteristics of the coupling. The determination can also be made from any combination of these. The earpiece can comprise both a microphone according to the embodiment demonstrated with reference to FIG. 1, i.e. picking up sounds in the auditory opening of the ear when applied, and a microphone according to the embodiment demonstrated with reference to FIG. 2, i.e. picking up sounds from outside the ear when applied. Determination can then be made based on one or more of the acoustic couplings elucidated above.

Based on the analysis of whether the earpiece 102, 202, or earpieces 102, 202 and 102*b*, 202*b*, are applied or not, an application controller 115, 215 which is arranged to receive the result of the determination can control behavior of one or more applications 116, 216. An application 116, 216 can comprise the application element 109, 209 arranged to output the audio content. One example on control of the application 116, 216 can be routing audio related to music or incoming/outgoing calls to the earpiece 102, 202 only when the earpiece is applied in the user's ear. Another example is to adjust ring tone volume to lower levels if it is detected that the earpiece 102, 202 is applied in the user's ear since the apparatus then most probably is close to the user. Further another example is to enable input from another microphone 118, 218 associated with the earpiece 102, 202, e.g. when it is a part of a headset comprising the earpiece 102 and the another microphone 118, 218, only when the earpiece 102, 202 is applied. Still another example is to turn on a wireless headset comprising the earpiece 102, 202 when the earpiece 102, 202 is applied, or turn it off when not applied. Another example is to determine if mono or stereo audio is to be output to earpiece or earpieces 102, 102*b*, 202, 202*b* depending on if one or two earpieces 102, 102*b*, 202, 202*b* are applied. Here, when only one earpiece of the two is applied, the audio output is routed only to the earpiece applied. Further another example is call acceptance, i.e. picking up an incoming call, when the earpiece 102, 202 is applied or upon application. Still another example is to start or resume audio rendering, e.g. from a media player upon application of the earpiece 102, 202, and stopping or pausing when detaching the earpiece 102, 202 from the ear. Any combination of these is of course possible for adapting to the nature of the application 116, 216.

Figure 3:
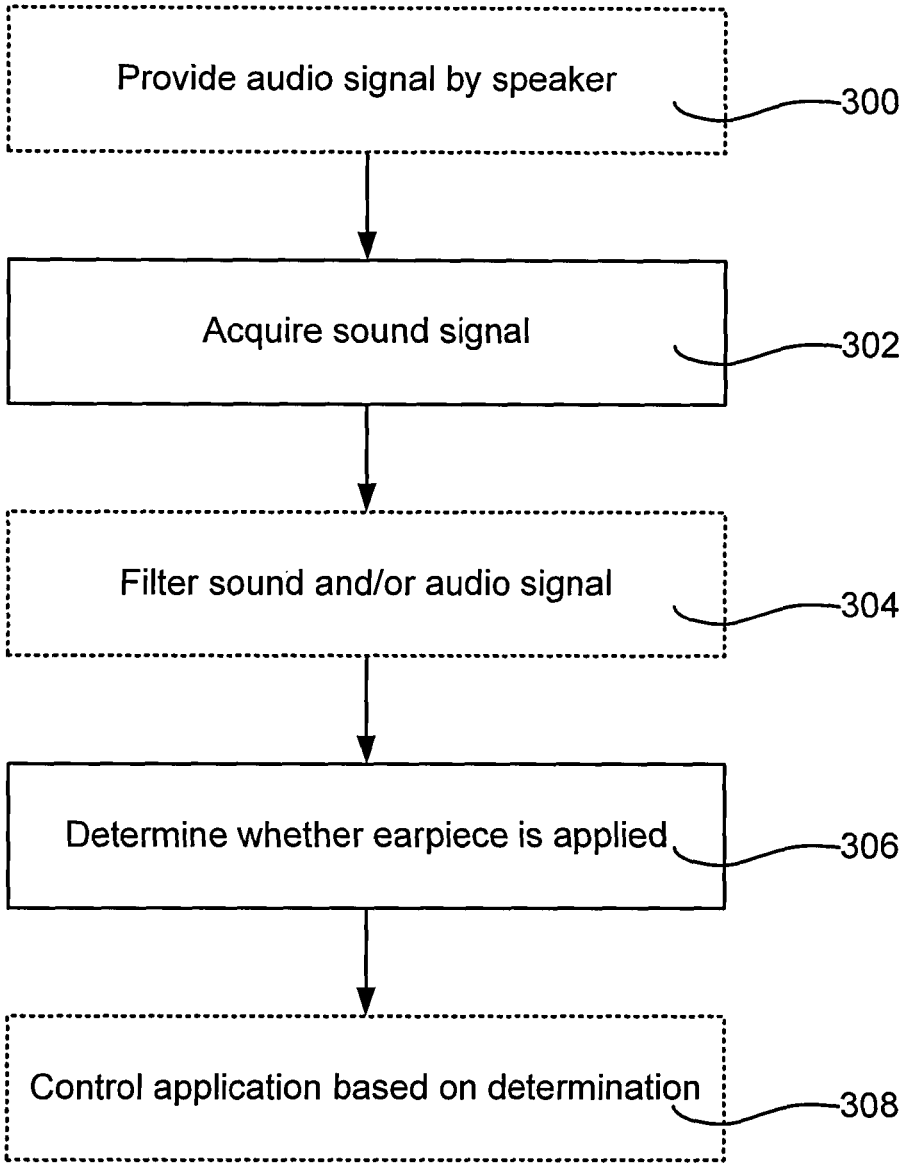
FIG. 3 is a flow chart illustrating a method according to an embodiment.

FIG. 3 is a flow chart illustrating a method according to an embodiment. The method is suitable for an earpiece to be applied at a user's ear for rendering an audio signal in the user's ear when the earpiece is applied at the ear, as demonstrated above with reference to FIGS. 1 and 2. The method comprises a sound acquisition step 302 where sounds are acquired by a microphone, which is arranged to acquire sounds according to any of the embodiments demonstrated with reference to FIGS. 1 and 2. The method further comprises a determination step 306 where it is determined whether the earpiece is applied at the user's ear. This is performed by analysis of the acquired sound signal regarding acoustic coupling between a speaker and a microphone. This can be performed as demonstrated with reference to FIGS. 1 and 2.

The method can comprise an audio provision step 300 where an audio signal is rendered by a speaker of the earpiece. Optionally, the acquired sound signal and/or the audio signal can be filtered before determination in a signal filtering step 304.

Based on the determination of whether the earpiece is considered to be applied or not, one or more applications can be controlled in an application control step 308. The controlling can for example comprise interrupting rendering associated with the audio signal based on the determination when the earpiece is determined to not be applied, and resuming the rendering when the earpiece is determined to be applied. Another example is establishing communication associated with the audio signal based on the determination when the earpiece is determined to be applied, e.g. picking up a telephone call, and terminating the communication when the earpiece is determined to not be applied, e.g. hanging up.

The demonstrated approach is particularly suitable for an earpiece of closed type.

Figure 4:
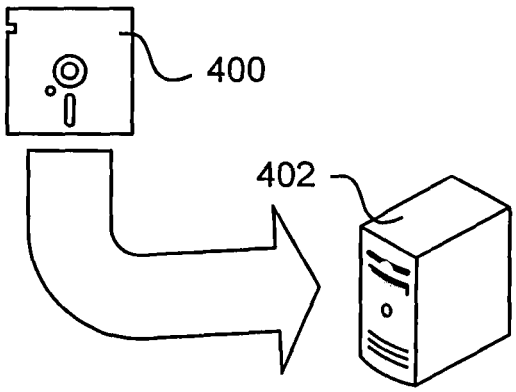
FIG. 4 schematically illustrates a computer readable medium.

The methods according to the present invention are suitable for implementation with aid of processing means, such as computers and/or processors. Therefore, there is provided computer programs, comprising instructions arranged to cause the processing means, processor, or computer to perform the steps of any of the methods according to any of the embodiments described with reference to FIG. 3, in the apparatus. The computer programs preferably comprises program code which is stored on a computer readable medium 400, as illustrated in FIG. 4, which can be loaded and executed by a processing means, processor, or computer 402 to cause it to perform the methods, respectively, according to embodiments of the present invention, preferably as any of the embodiments described with reference to FIG. 3. The computer 402, which can be present in the apparatus as illustrated in any of FIGS. 1 and 2, and computer program product 400 can be arranged to execute the program code sequentially where actions of the any of the methods are performed stepwise, or be performed on a real-time basis, where actions are taken upon need and availability of needed input data. The processing means, processor, or computer 402 is preferably what normally is referred to as an embedded system. Thus, the depicted computer readable medium 400 and computer 402 in FIG. 4 should be construed to be for illustrative purposes only to provide understanding of the principle, and not to be construed as any direct illustration of the elements.

The invention claimed is:

1. An apparatus comprising:

at least two earpieces suitable to be applied at auditory openings of a user's ears, each of the earpieces comprising:

a speaker enabled to be supplied with an audio signal for rendering, and a microphone arranged in vicinity of the speaker arranged to acquire a sound signal; and a signal processor, wherein the signal processor is arranged to determine whether the earpieces are applied at the user's ears by analysis of the acquired sound signal, wherein the analysis is based on the acoustic coupling of the audio signal from a speaker of one of the earpieces to a microphone of one of the earpieces, wherein the acoustic coupling is between the speaker of one earpiece and the microphone of another earpiece.

2. The apparatus according to claim 1, wherein the microphone of one of the earpieces is arranged to acquire a sound signal from sounds present inside an auditory opening of the user's ear when the earpiece is applied at the ear.

3. The apparatus according to claim 2, wherein acoustic coupling also occurs between the speaker and the microphone of one or each earpiece.

4. The apparatus according to claim 1, wherein the analysis is based on a propagation delay between the speaker of the one earpiece and the microphone of the another earpiece wherein the earpieces are determined to be applied if the propagation delay corresponds to a delay for propagating through a head.

5. The apparatus according to claim 1, wherein an audio signal provided to the one earpiece comprises a sub-signal such that the sound signal acquirable at the another earpiece comprises a signal component emanating from sound provided at the user's other ear and which sound is modulatedly attenuated by pulsating blood of veins of the user when the sound propagates through the head of the user when the earpieces are applied, such that a heartbeat is extractable from the signal component to determine that the earpieces are applied.

6. The apparatus according to claim 5, wherein the signal processor is arranged to extract the heartbeat by low pass filtering the sound signal in a low pass filter.

7. The apparatus according to claim 6, wherein the low pass filter has a cutoff frequency between 3 and 10 Hz.

8. The apparatus according to claim 1, wherein the audio signal provided to the one earpiece comprises a sub-signal comprising any of a tone in sub-sonic or ultra-sonic frequency, and a wideband pulse, and the signal processor is arranged to discriminate the acquired sound signal at the another earpiece to determine the acoustic coupling.

9. The apparatus according to claim 1, wherein the microphone is arranged to acquire a sound signal from sounds present outside the earpiece.

10. The apparatus according to claim 9, wherein acoustic coupling also occurs between the speaker and the microphone of one or each earpiece.

11. The apparatus according to claim 1, further comprising an application arranged to control features of the application based on the determination whether the earpiece is applied or not.

12. The apparatus according to claim 11, wherein the application is arranged to interrupt rendering associated with the audio signal when the signal processor has determined that the earpiece is not applied, and arranged to resume the rendering when the signal processor has determined that the earpiece is applied.

13. The apparatus according to claim 11, wherein the application is arranged to establish communication associated with the audio signal when the signal processor has determined that the earpiece is applied, and arranged to terminate the communication when the signal processor has determined that the earpiece is not applied.

14. A method, for an apparatus comprising at least two earpieces suitable to be applied at a user's ears for rendering an audio signal in the user's ears when the earpieces are applied at the ears, each of the earpieces comprising a speaker enabled to be supplied with the audio signal for rendering and a microphone arranged in vicinity of the speaker, the method comprising providing the audio signal to the speaker of one earpiece, acquiring a sound signal by the microphone of another earpiece; and determining by a signal processor whether one of the earpieces is applied at the user's ear by analyzing the sound signal based on acoustic coupling of the audio signal from the speaker of the one earpiece to the microphone of the another earpiece.

15. The method according to claim 14, wherein the acquiring comprises acquiring a sound signal at a position of the earpiece such that sounds present inside an auditory opening of the user's ear are acquired when the earpiece is applied at the ear.

16. The method according to claim 15, wherein acoustic coupling also occurs between the speaker and the microphone of one or each earpiece.

17. The method according to claim 14, wherein the analyzing comprises determining a propagation delay between the speaker of the one earpiece and the microphone of the another earpiece wherein the earpieces are determined to be applied if the propagation delay corresponds to a delay for propagating through a head.

18. The method according to claim 14, wherein the audio signal provided to the one earpiece comprises a sub-signal such that the sound signal acquirable at the another earpiece comprises a signal component emanating from sound provided at the user's other ear and which sound is modulatedly attenuated by pulsating blood of veins of the user when the sound propagates through the head of the user when the earpieces are applied, such that a heartbeat is extractable from the signal component to determine that the earpieces are applied.

19. The method according to claim 18, further comprising extracting the heartbeat by low pass filtering the sound signal in a low pass filter.

20. The method according to claim 19, wherein the low pass filter has a cutoff frequency between 3 and 10 Hz.

21. The apparatus according to claim 14, wherein the providing of the audio signal to the one earpiece comprises providing a sub-signal comprising any of a tone in sub-sonic or ultra-sonic frequency, and a wideband pulse, and the analyzing comprises discriminating the acquired sound signal at the another earpiece to determine the acoustic coupling.

22. The method according to claim 14, wherein the acquiring comprises acquiring a sound signal at a position of the earpiece such that sounds present outside the earpiece are acquired although the earpiece is applied at the ear.

23. The method according to claim 22, wherein acoustic coupling also occurs between the speaker and the microphone of one or each earpiece.

24. The method according to claim 14, further comprising controlling features of an application based on the determination.

25. The method according to claim 24, further comprising interrupting rendering associated with the audio signal when the signal processor has determined that the earpiece is not applied; and resuming the rendering when the signal processor has determined that the earpiece is applied.

26. The method according to claim 24, further comprising establishing communication associated with the audio signal when the signal processor has determined that the earpiece is applied; and terminating the communication when the signal processor has determined that the earpiece is not applied.

27. A non-transitory computer readable medium comprising program code comprising instructions which when executed cause a method to be performed, the method comprising:

supplying an audio signal to a speaker of at least one earpiece suitable to be applied at a user's ear for rendering the audio signal in the user's ear when the earpiece is applied at the ear;

acquiring a sound signal by a microphone of the earpiece arranged in vicinity of the speaker; wherein the supplying of the audio signal is made to one earpiece and the acquiring is made at another earpiece, and determining whether the earpiece is applied at the user's ear by analysis of the acquired sound signal based on acoustic coupling of the audio signal from the speaker of the one earpiece to the microphone of the another earpiece.

28. The non-transitory computer readable medium according to claim 27, wherein the analysis comprises determining a propagation delay between the speaker of the one earpiece and the microphone of the another earpiece wherein the earpieces are determined to be applied if the propagation delay corresponds to a delay for propagating through a head.

29. The non-transitory computer readable medium according to claim 27, wherein the audio signal provided to the one earpiece comprises a sub-signal such that the sound signal acquirable at the another earpiece comprises a signal component emanating from sound provided at the user's other ear and which sound is modulatedly attenuated by pulsating blood of veins of the user when the sound propagates through the head of the user when the earpieces are applied, such that a heartbeat is extractable from the signal component to determine that the earpieces are applied.

30. The non-transitory computer readable medium according to claim 29, further comprising instructions for extracting the heartbeat by low pass filtering the sound signal in a low pass filter.

31. The non-transitory computer readable medium according to claim 30, wherein the low pass filter has a cutoff frequency between 3 and 10 Hz.

32. The non-transitory computer readable medium according to claim 27, wherein the providing of the audio signal to the one earpiece comprises providing a sub-signal comprising any of a tone in sub-sonic or ultra-sonic frequency, and a wideband pulse, and the analyzing comprises discriminating the acquired sound signal at the another earpiece to determine the acoustic coupling.

33. The non-transitory computer readable medium according to claim 27, wherein the acquiring comprises acquiring a sound signal at a position of the earpiece such that sounds present outside the earpiece are acquired although the earpiece is applied at the ear.

34. The non-transitory computer readable medium according to claim 27, further comprising instructions for controlling features of an application based on the determination.

35. The non-transitory computer readable medium according to claim 34, further comprising instructions for interrupting rendering associated with the audio signal when the processor has determined that the earpiece is not applied; and resuming the rendering when the processor has determined that the earpieces is applied.

36. The computer readable medium according to claim 34, further comprising instructions for establishing communication associated with the audio signal when the processor has determined that the earpiece is applied; and terminating the communication when the processor has determined that the earpiece is not applied.

* * * * *

UNITED STATES PATENT AND TRADEMARK OFFICE

CERTIFICATE OF CORRECTION

PATENT NO. : 8,199,956 B2
APPLICATION NO. : 12/358289
DATED : June 12, 2012
INVENTOR(S) : Haartsen et al.

It is certified that error appears in the above-identified patent and that said Letters Patent is hereby corrected as shown below:

Claim 36, Column 12, Line 6, replace "36. The computer readable medium according to claim 34," with --36. The non-transitory computer readable medium according to claim 34--.

Signed and Sealed this
Fourteenth Day of August, 2012

David J. Kappos

David J. Kappos
*Director of the United States Patent and Trademark Office*